US010953296B1

(12) United States Patent
Higgins

(10) Patent No.: US 10,953,296 B1
(45) Date of Patent: Mar. 23, 2021

(54) SYSTEMS AND METHODS FOR PRACTICING STRIKES

(71) Applicant: Matthew Higgins, Waverly, MN (US)

(72) Inventor: Matthew Higgins, Waverly, MN (US)

( * ) Notice: Subject to any disclaimer, the term of this patent is extended or adjusted under 35 U.S.C. 154(b) by 591 days.

(21) Appl. No.: 15/231,609

(22) Filed: Aug. 8, 2016

Related U.S. Application Data

(60) Provisional application No. 62/201,746, filed on Aug. 6, 2015.

(51) Int. Cl.
*A63B 69/00* (2006.01)
*A63B 69/20* (2006.01)

(52) U.S. Cl.
CPC ..... *A63B 69/004* (2013.01); *A63B 69/20* (2013.01); *A63B 2225/09* (2013.01)

(58) Field of Classification Search
CPC . A63B 69/004; A63B 2069/004; A63B 21/05; A63B 21/04
See application file for complete search history.

(56) References Cited

U.S. PATENT DOCUMENTS 2,435,864 A * 2/1948 Adams ..... A63B 69/20 482/90
3,724,845 A * 4/1973 Irby ..... A63B 69/205 482/83
4,186,922 A * 2/1980 Ketchum ..... A63B 69/345 473/443
4,635,929 A * 1/1987 Shustack ..... A63B 69/004 482/83
4,653,746 A * 3/1987 Brunier ..... A63B 69/201 473/442
4,662,630 A * 5/1987 Dignard ..... A63B 69/004 482/83
4,721,302 A * 1/1988 Murphy ..... A63B 69/201 473/442
4,749,184 A * 6/1988 Tobin ..... A63B 69/0091 482/129
4,817,941 A * 4/1989 McCorry ..... A63B 69/004 482/87
5,111,771 A * 5/1992 Mathews ..... A01K 15/025 119/708
5,277,679 A * 1/1994 Wells ..... A63B 69/004 482/83
5,389,057 A * 2/1995 Zagata, Jr. ..... A63B 69/004 482/83
5,554,088 A * 9/1996 Zlojutro ..... A63B 69/004 482/83
5,613,925 A * 3/1997 Miasserian ..... A63B 69/0053 482/83
5,679,103 A * 10/1997 Pratchett ..... A63B 69/004 482/83
5,702,327 A * 12/1997 Fullbright ..... A63B 69/20 473/441
5,725,458 A * 3/1998 Newman ..... A63B 69/201 482/83

(Continued)

*Primary Examiner* — Garrett K Atkinson
(74) *Attorney, Agent, or Firm* — Underwood & Associates, LLC

(57) ABSTRACT

A strike practice assembly includes a striking arm, a framework for supporting said striking arm and providing a rotational axis therefor, and, optionally, one or more elastic band members that can be configured to resiliently return said striking arm to a pre-strike position after being struck.

19 Claims, 5 Drawing Sheets

(56) References Cited

U.S. PATENT DOCUMENTS

| | | | | |
|---|---|---|---|---|
| 5,800,319 | A * | 9/1998 | Choate | A63B 69/34 482/83 |
| 7,678,028 | B1 * | 3/2010 | Gore | A63B 69/004 482/86 |
| 8,012,047 | B2 * | 9/2011 | Gamboa | A63B 69/00 473/438 |
| 9,192,840 | B2 * | 11/2015 | Thomas | A63B 69/004 |
| 9,669,278 | B1 * | 6/2017 | Brown | A63B 69/004 |
| 9,737,780 | B1 * | 8/2017 | Khunkhun | A63B 69/201 |
| 9,808,694 | B2 * | 11/2017 | Stevens | A63B 69/004 |
| 9,839,827 | B1 * | 12/2017 | Roberts | A63B 23/12 |
| 10,252,135 | B1 * | 4/2019 | Roberts | A63B 69/203 |
| 2011/0163503 | A1 * | 7/2011 | Townsend | F41J 5/18 273/355 |
| 2014/0128227 | A1 * | 5/2014 | Ladas | A63B 69/20 482/84 |

* cited by examiner

SYSTEMS AND METHODS FOR PRACTICING STRIKES

CROSS REFERENCE TO RELATED APPLICATIONS

This application claims priority to and the benefit under 35 USC § 119(e) of U.S. Provisional Patent Application No. 62/201,746, filed on Aug. 6, 2015, the contents of which are incorporated by reference in their entirety as if fully set forth herein.

TECHNICAL FIELD

This disclosure relates to systems and methods for practicing strikes, e.g., kicks and punches executed by practitioners in the martial arts, boxing and related disciplines.

BACKGROUND

Practitioners of martial arts, boxing and related disciplines often times utilize padded surfaces to practices strikes, such as kicks and punches. Such padded surfaces may be in the form of heavy bags, focus mitts, speed bags and other equipment which can be mounted, e.g., on a wall or worn by an opponent or helper.

SUMMARY

In one illustrative aspect, a system including, inter alia, a modular support framework for supporting one or more rotatable striking arms is described. The striking arms can include padded end portions configured to be struck by a practitioner and are configured to be rotatably mounted on a rigid framework for either horizontal or vertical rotational motion. In one embodiment, elastic bands can be attached between a portion of the framework and a portion of an arm to control rotational motion of the striking arm, for example, to cause the striking arm to return toward a pre-strike position after being struck by a practitioner. Alternatively, the system can be used without elastic bands, which allows the striking arms to rotate freely after being struck. The rigid frameworks and striking arms are configurable to provide a number of different practice configurations for striking, blocking and other moves.

In one exemplary aspect, a strike practice assembly is described. The strike practice assembly includes a frame assembly supporting a rotatably-mounted arm having a striking pad mounted thereupon at a first end portion, and at least one band-attachment member disposed on the rotatably-mounted arm for receiving a first portion of at least one elastic band. The at least one band-attachment member and the elastic band are configured to provide adjustable rebound of the rotatably-mounted arm when the striking pad is struck.

In one embodiment, a second, different portion of the elastic band is coupled to the frame assembly.

In one embodiment, the strike practice assembly includes between two and four band-attachment members. In a related embodiment, the strike practice assembly includes a plurality of band-attachment members disposed along a long axis of the rotatably-mounted arm.

In one embodiment, the frame assembly includes a rotatably-mounted shaft spanning first and second V-shaped frame members, wherein each of the first and second V-shaped members are coupled to a base. In a related embodiment, the rotatably-mounted shaft is coupled to the apex of each of the first and second V-shaped frame members. In another related embodiment, the strike practice assembly includes a post member disposed proximal to the apex of the first V-shaped frame member, and a recess having a complimentary size and shape to receive the post member, disposed proximal to the apex of the second V-shaped frame member. In a related embodiment, the strike assembly is modularly configured to couple to a second one of the strike practice assemblies.

In one embodiment, the frame assembly includes at least three beam members configured such that a first end portion of each of the beam members converge to form an apex.

In one embodiment, the at least one band-attachment member and the at least one elastic band are configured to provide adjustable rotational travel of the rotatably-mounted arm.

In one embodiment, the rotatably-mounted arm is configured to receive a reversibly-insertable extension member on an end portion opposite the striking pad. In a related embodiment, the adjustable rotational travel of the rotatably-mounted arm is approximately thirty (30), sixty (60), ninety (90), one-hundred eighty (180), two-hundred seventy (270) or three-hundred sixty (360) degrees.

In one exemplary aspect, a strike practice assembly is disclosed. The strike practice assembly includes at least three beam members configured such that a first end portion of each of the beam members converge to form an apex. The strike practice assembly further includes a rotatable arm, including a striking pad coupled to a first end portion, and a stop member extending substantially perpendicularly therefrom. The rotatable arm is coupled to the apex. The strike practice assembly further includes an elastic band coupled proximal to the apex, and a band-attachment member coupled proximal to the apex that is configured to allow the elastic band to be extended such that contact is made between the elastic band and the stop member when the rotatable arm rotates.

In one embodiment, the band-attachment member is substantially U-shaped.

In one embodiment, the strike practice assembly further includes a base member configured to mount the strike practice assembly to a surface.

In one embodiment, the length of the adjustable arm is adjustable.

In yet another exemplary aspect, a strike practice assembly includes a rotatable arm member having a striking pad disposed on one end thereof that is coupled to a frame assembly, and at least one combination of an elastic band and an elastic band catch, wherein the elastic band catch is disposed on the rotatable arm member. The at least one combination of an elastic band and an elastic band catch provide the capability of rebounding the rotatable arm after the striking pad has been struck.

In one embodiment, one portion of the elastic band is coupled to the frame assembly.

In one embodiment, when the at least one combination of an elastic band and an elastic band catch is configured such that two of the elastic bands can be engaged to the rotatable arm.

In one embodiment, the length of the extendable arm is adjustable.

Unless otherwise defined, all technical and scientific terms used herein have the same meaning as commonly understood by one of ordinary skill in the art. Although methods and materials similar or equivalent to those described herein can be used in the practice or testing of any described embodiment, suitable methods and materials are described below. In addition, the materials, methods, and examples are illustrative only and not intended to be limiting. In case of conflict with terms used in the art, the present specification, including definitions, will control.

The foregoing summary is illustrative only and is not intended to be in any way limiting. In addition to the illustrative aspects, embodiments, and features described above, further aspects, embodiments, and features will become apparent by reference to the drawings and the following detailed description and claims.

DESCRIPTION OF DRAWINGS

The present embodiments are illustrated by way of the figures of the accompanying drawings, which may not necessarily be to scale, in which like references indicate similar elements, and in which:

FIG. 2A illustrates an alternative embodiment of a frame for supporting rotation of a striking arm;

DETAILED DESCRIPTION OF ILLUSTRATIVE EMBODIMENTS

In general, the present disclosure provides a strike practice system for practitioners of the martial arts, boxing and other related disciplines. A "strike" as used herein refers to any type of kick, punch, or movement of a body part in striking motion as commonly used to impart a blow to an opponent. As will be realized from the following description, the strike practice systems described herein are configured to provide a target striking surface or pad with an adjustable amount of resistance and quick return to its original, pre-strike position or, in some cases, be allowed to rotate freely. In some embodiments, striking surfaces are disposed on opposite end portions of an elongate striking arm which is configured to rotate on an axis generally about its midpoint. In such embodiments, the elongate arm is attached to a framework having one or more elastic bands coupled thereto at one end; the other end is coupled to a portion of the elongate arm which supplies a resistance to spinning motion of the arm when struck and also returns—i.e., rebounds the striking surface toward a pre-strike position.

Figure 1:
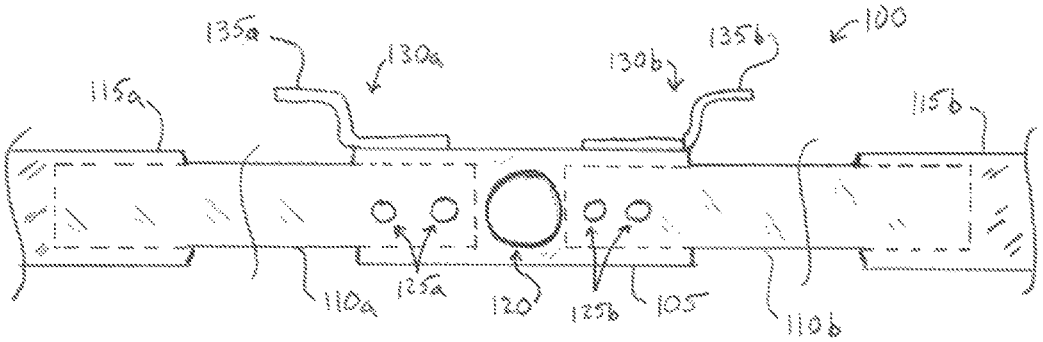
FIG. 1 is a striking arm according to one embodiment.

Referring now to FIG. 1, a striking arm 100 is illustrated according to one embodiment. In this embodiment, the striking arm 100 includes a rigid jacket member 105 which can be, for example, a length of square steel tubing having a hollow interior. Attached to the jacket member 105 are two S-shaped band-attachment members 130*a*, 130*b* which are configured such that end portions 135*a*, 135*b* extend beyond the length of the jacket 105 as illustrated. In this embodiment, each end portion 135*a*, 135*b* is configured to receive a portion of an elastic band as described in greater detail below.

In this embodiment, jacket 105 is configured to receive end portions of elongate bar members 110*a*, 110*b* as illustrated. In FIG. 1, end portions of elongate bar members 110*a*, 110*b* are illustrated in dashed lines within jacket 105. Jacket 105 includes aperture sets 125*a*, 125*b* which match complimentary apertures disposed in the end portions of elongate bar members 110*a*, 110*b* such that a locking member such as a screw, bolt, pin or other hardware can be inserted therein to securely couple elongate bar members 110*a* or 110*b* to jacket 105. When inserted, the locking member secures the relative position of the elongate bar 110*a*, 110*b* to the jacket 105. Jacket 105 further includes a central aperture 120 configured to receive a portion of axle 240 (FIG. 2) so that it can freely rotate thereupon, as described in greater detail below.

In this embodiment, striking pads 115*a*, 115*b* are secured to end portions of elongate bar members 110*a*, 110*b* respectively, as illustrated. Striking pads 115*a*, 115*b* can be of any desired shape or size commensurate for use as a surface for striking with hands, feet or other body parts. In one embodiment, striking arm 100 is configured to be substantially equally-weighted about central aperture 120 when two opposing striking pads 115*a*, 115*b* are inserted therein, so that when one of striking pads 115*a*, 115*b* is struck, the arm 100 exhibits balanced rotation. In one embodiment, a counterweight (not illustrated) can be configured to be removably inserted and secured into one end of jacket 105 so that one striking pad can be used at a time. It should be understood that a practitioner can choose whether to use one or two striking arms, a combination of striking arm and counterweight, or a single striking arm alone, as preferred.

Figure 2:
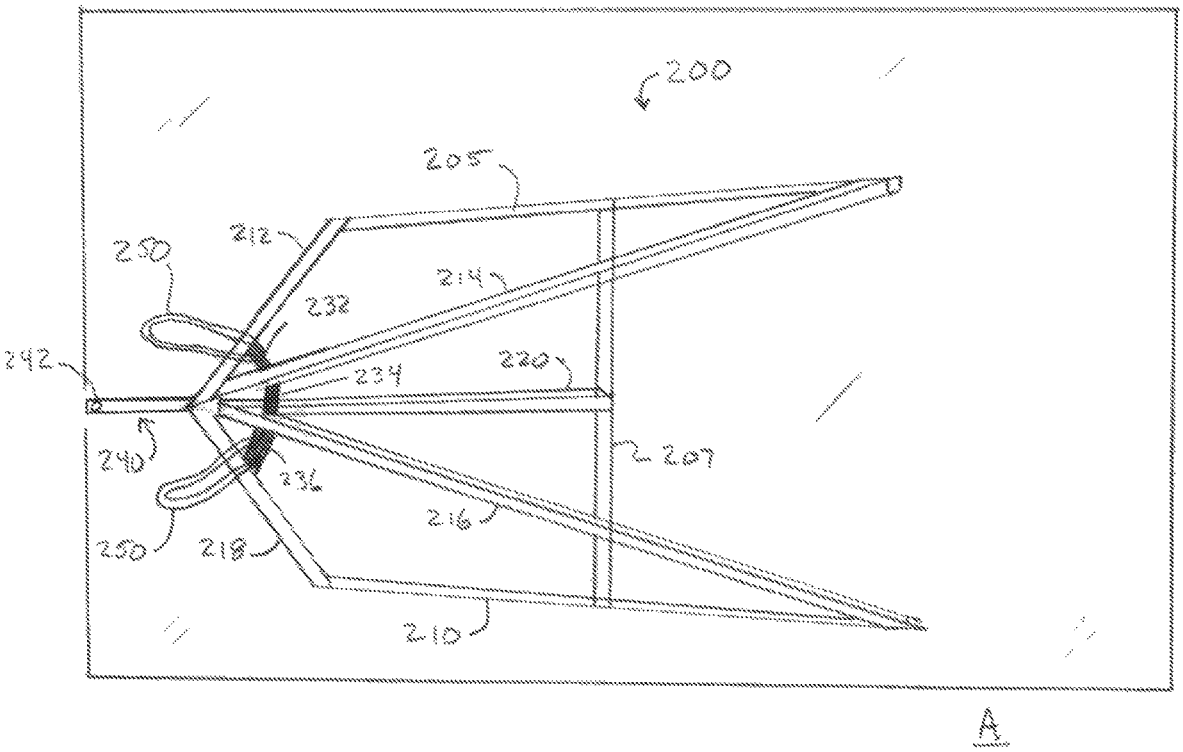
FIG. 2 illustrates a frame for supporting rotation of a striking arm in a vertical plane, according to one embodiment.
Figure 2:
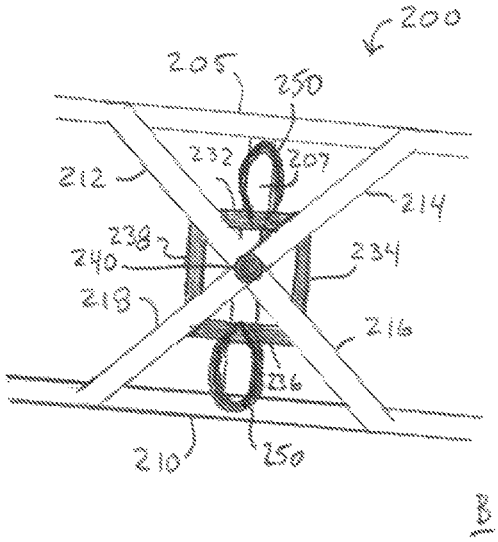

Referring now to FIG. 2, a frame 200 of a strike-practicing assembly is shown in isometric (frame A) and top-plan (frame b) views according to one embodiment. In this embodiment, the frame 200 includes first and second wall-mounting struts 205, 210 respectively which are configured to be anchored to a wall. In various embodiments, the wall-mounting struts 205, 210 can be anchored to walls of various types using attachment hardware of choice, including bolts, screws, masonry anchors, etc.

In this embodiment, first (212), second (214), third (216) and fourth (218) beam members are configured to form a substantially square-pyramidal shape, wherein a first end portion of each beam member is attached to an end portion of one of the wall-mounting struts, and the second end portions of each beam member are convergently oriented to form the apex of the square pyramid, as illustrated.

In this embodiment, a fifth beam member 207 spans the wall-mounting struts 205, 210 and is substantially perpendicularly oriented and attached therebetween. Sixth beam member 220 spans the apex of the square pyramid (e.g., is attached to portions of beam members 212, 214, 216 and 218, as illustrated) and the fifth beam member 207 to provide stability of the frame 200.

In this embodiment, cross-members 232, 234, 236 and 238 span upper portions between beam members 212 and 214, 214 and 216, 216 and 218 and 218 and 220 as illustrated. In this embodiment, an axle 240 is securely affixed to the apex of the frame 200 and extends substantially perpendicular to the wall on which the frame 200 is mounted, e.g., coaxial with sixth beam member 220.

In this embodiment, the axle is configured to provide support and rotation of striking arm 100. In a preferred embodiment, the cross-sectional diameter of axle 240 is slightly less than the diameter of central aperture 120 of striking arm 100 to provide smooth rotation thereabout. Aperture 242 is disposed at an end portion of axle 240 to allow a locking pin to extend therethrough to prevent striking arm 100 from inadvertently falling off.

In this embodiment, cross members 232, 234, 236 and 238 provide for the attachment of a portion of one or more resiliently elastic bands 250. In use, the number of bands used and the placement thereof on frame 200 can be selected by the practitioner. In the exemplary illustration of FIG. 2 (Frame A), one band 250 extends around cross-members 232 and 236 which provides two looped portions that can be looped around end portions 135*a*, 135*b* of striking arm 100. In other, alternative approaches, separate bands can be attached at one end—or portion—to a cross-member, e.g., cross member 232, and attached at an opposite end—or portion—to an end portion 135*a* or 135*b* of striking arm 100.

FIG. 2A illustrates an alternative approach for the utilization of bands in restricting the rotational motion of striking arm 100, wherein the frame 200 region of the strike-practicing assembly and a portion of the striking arm 100 is shown in a magnified view. In this embodiment, four (4) S-shaped band-holding members 270, 272, 274 are coupled proximal to the apex where beam members 212 and 214, 214 and 216 intersect (the fourth S-shaped band-holding member is not visible in FIG. 2A). In this embodiment, striking arm 100 includes a vertically-oriented stop member 280 having a length sufficient to contact band 276, 278 which prevents rotation of the striking arm 100 beyond the contact point therebetween. FIG. 2A illustrates two bands in use; however, it should be understood that any number of bands, in any desired configuration or orientation can be used to effect a desired practice mode. For example, if only one band is used (e.g., band 276), then the striking arm 100 can rotate substantially 360 degrees when struck. Alternatively, if bands 276 and 278 are used as shown, then the rotation of striking arm 100 can be limited to approximately 90 degrees.

Figure 3:
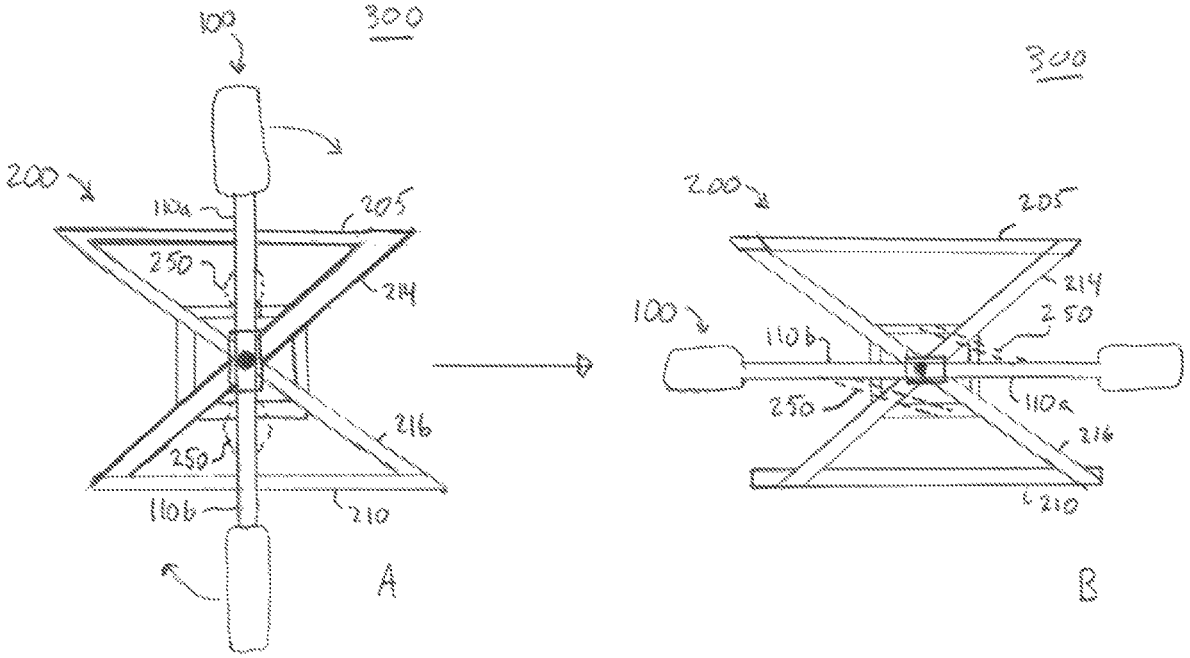
FIG. 3 illustrates rotational motion in a vertical plane of a striking arm mounted on a frame, according to one embodiment.

Referring now to FIG. 3, a strike practice assembly 300 is illustrated according to one embodiment, which shows striking arm 100 mounted onto frame 200 in an operative configuration. FIG. 3 illustrates the position of striking arm 100 in a pre-strike configuration (Frame A) and a post-strike configuration (Frame B). In this example, the elastic bands 250 are in a relaxed state in the pre-strike configuration which allows striking arm 100 to remain at rest; after being struck, however, the striking arm 100 rotates, causing the elastic bands 250 to stretch, as illustrated. When the resiliency of the elastic bands 250 overcomes the angular momentum of the striking arm 100, the striking arm 100 is urged back toward the pre-strike configuration, and can, in some embodiments, rotate beyond the pre-strike configuration (e.g., counter-clockwise in the illustration shown).

In this and other embodiments, the resulting angular velocity of the striking arm 100 after being struck on a one of the striking pads 115*a*, 115*b* can be selected based upon the resiliency (elasticity) and length of the elastic bands 250. Thus, the 'action' of the striking arm 100 can be selected by a practitioner according to the properties of the elastic band 250. It should be understood that a practitioner can elect to not use an elastic band, which can result in the striking arm spinning freely after being struck.

In this and other embodiments, a practitioner can practice a wide variety of striking techniques against striking pads 115*a*, 115*b*, causing striking arm 100 to rotate accordingly. For example, a solo practitioner can practice repeated round-house kicks against one or both pads, causing the striking arm 100 to rotate, and thereby causing the practitioner to hone, e.g., his foot-eye coordination, timing and strength. In another example, two practitioners can stand on opposite sides of the assembly 300 and strike the striking pads 115*a*, 115*b* in such a way as to create a type of 'volley' between them. Various games and challenges can be played, for example, to see which practitioner can execute repeated kicks to one of the striking pads 115*a*, 115*b* while standing on one leg for the longest period of time.

In this and other embodiments, it should be understood that practitioners can execute any number and type of strikes against striking pads 115*a*, 115*b* alone, including, but not limited to: jabs, crosses, uppercuts, ridge hand, chop, palm, vertical elbow, knee, front-kick, side-kick, round-house kick, hook kick, etc. Dual-user strikes can include, without limitation: jabs, crosses, uppercuts, elbow, knee, front-kick, chop, palm, etc. Other types of martial art, boxing or sport fighting techniques can be practiced including, but not limited to blocks, e.g., high block, low block, evasions, etc. Any combination of strikes and blocks can be practiced by one or more practitioners. For example, a single user can execute an uppercut strike to a first striking pad 115*a* which causes the striking arm 100 to rotate; the practitioner can then ready himself to block the second striking pad 115*b* as it rotates toward him.

In this and other embodiments, the system 300 provides for multiple skill practice levels by selection of the resiliency of elastic bands 250 or by not using an elastic band at all. For example, elastic bands 250 with greater elasticity can cause the striking arm 100 to rotate further, sometimes making several rotations, while elastic bands 250 with less elasticity can cause the striking arm 100 to return toward a pre-strike configuration faster, which may increase the skill level required to execute a plurality of strikes with rapid execution.

In one embodiment, various attachments can be used in addition to, or in lieu of striking pads 115*a*, 115*b* in order to increase a particular skill level. For example, to increase hand-eye coordination, striking pads 115*a*, 115*b* can be removed and replaced by a tethered ball, which would serve as the striking target. In this case, the difficulty in striking the ball may be increased relative to the aforementioned striking pads 115*a*, 115*b* due to the additional degrees of freedom in travel as the tether and ball rotate with the striking arm 100. In such an embodiment, the tether can be, e.g., a rope, cord, flexible rod or other flexible member capable of coupling the striking target to an end portion of jacket 105. Alternatively, an adaptor member (not illustrated) can be configured to be inserted and coupled to one end of jacket 105 that includes an aperture, lock or other securing mechanism on an opposite end that is configured to secure the tether to the adaptor member.

Figure 4:
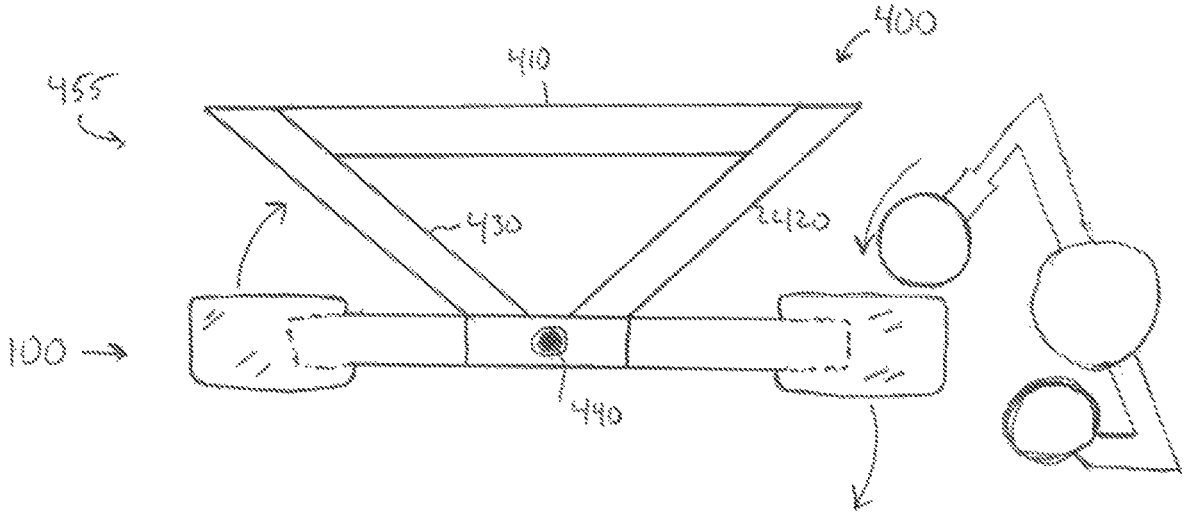
FIG. 4 is a framework for supporting rotation of a striking arm in a horizontal plane, according to one embodiment.
Figure 5:
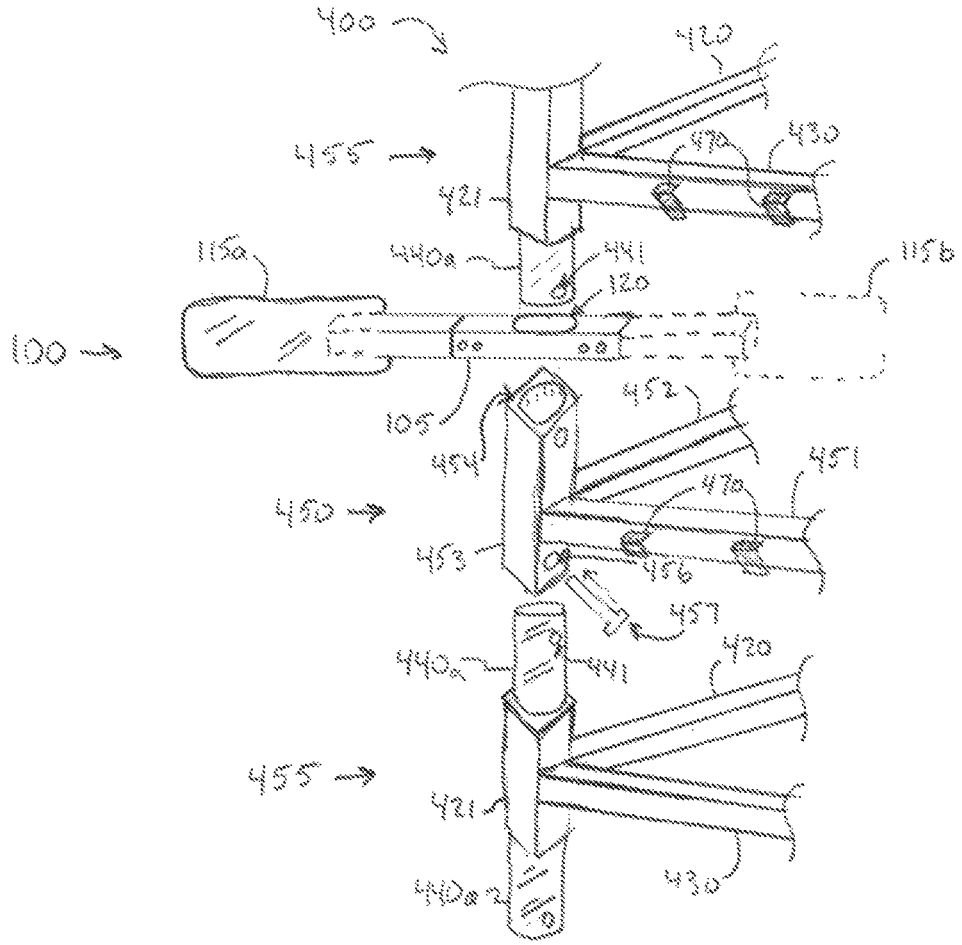
FIG. 5 illustrates a stackable framework assembly for supporting one or more striking arms for horizontal rotational motion, according to one embodiment.

Referring now to FIGS. 4 and 5, in one embodiment, striking arm 100 can be mounted on a portion of a framework 400. FIG. 4 illustrates a top plan view of the framework 400 and a striking arm 100 rotatably coupled thereto, according to one embodiment; FIG. 5 illustrates an exploded view of the framework 400 according to one embodiment. Framework 400 provides the ability to mount striking arm 100 such that it rotates in a horizontal plane, e.g., when the framework 400 is mounted to a wall.

Referring first to FIG. 4, in this embodiment, the striking arm 100 is rotatably supported by a first A-frame assembly 455 that includes first, second and third beam members 410, 420, 430, respectively configured in a substantially triangular shape as illustrated. In this embodiment, beam member 410 is configured to be attached to, e.g., a vertical wall such that the apex of the triangle (where the striking arm 100 is coupled) is disposed away from the wall. In this embodiment, beam members 420, 430 converge and are attached to vertical beam member 421. Vertical beam member 421 in this example is a length of square tubing that includes a cylindrical axis 440*a* extending coaxially therefrom as illustrated. Axis 440*a* has a cross-sectional diameter slightly less than aperture 120 of jacket 105 so that it can fit therethrough and act as an axis of rotation for the striking arm 100.

In this embodiment, the assembly 400 includes a similarly A-shaped, middle framework 450. Middle framework 450 is also configured to be secured to a wall and includes beam members 451, 452 that converge and are connected to vertical beam member 453. Vertical beam member 453 in this example is a length of square tubing having a collar disposed in each terminal end to form a cylindrically-shaped receptacle for receiving a portion of cylindrical axis 440*a* on each of its two opposite ends as illustrated.

In this embodiment, the assembly 400 is scalable; it can be made to include any desired number of striking arms 100 by inserting them between A-frame assemblies, e.g., between A-frame assembly 455 and middle framework 450. In this embodiment, A-frame assemblies are coupled together using a pin 457 which is configured to be inserted through an aperture 456 disposed on vertical beam member 453 and a bore 441 disposed on an end portion of axis 440*a* as illustrated.

In this and other embodiments, framework 400 allows a practitioner to practice various types of strikes, blocks, and other moves, e.g., those described previously, utilizing a horizontally-rotating striking arm 100. As with other embodiments, the striking arm can be configured as desired using one or two striking pads; for illustration, in FIGS. 5 and 6 the striking arm 100 is shown with one striking pad 115*a*. (Striking pad 115*b* is illustrated in dashed lines to show its relative placement if it were attached to jacket 105.)

In this embodiment, elastic bands 250 can be used in a variety of ways for controlling the reaction movement of the striking arm 100 after being struck. For example, in one approach, a band can be looped around a bracket member 470 disposed on beam member 451 or 452 at one end, and around end portion 135*a* or 135*b* at the other end. In another approach, one or more bands 250 can be stretched between bracket members 470 of beam members 451 or 452 of adjacent A-frame components, e.g., between beam member 430 and 451, to provide a resilient stop which intercepts the rotating striking arm 100 and returns it toward its pre-strike position. (See, e.g., FIG. 6, where elastic band 250 extends between bracket members 470 of beam members 420 and 451.)

Figure 6:
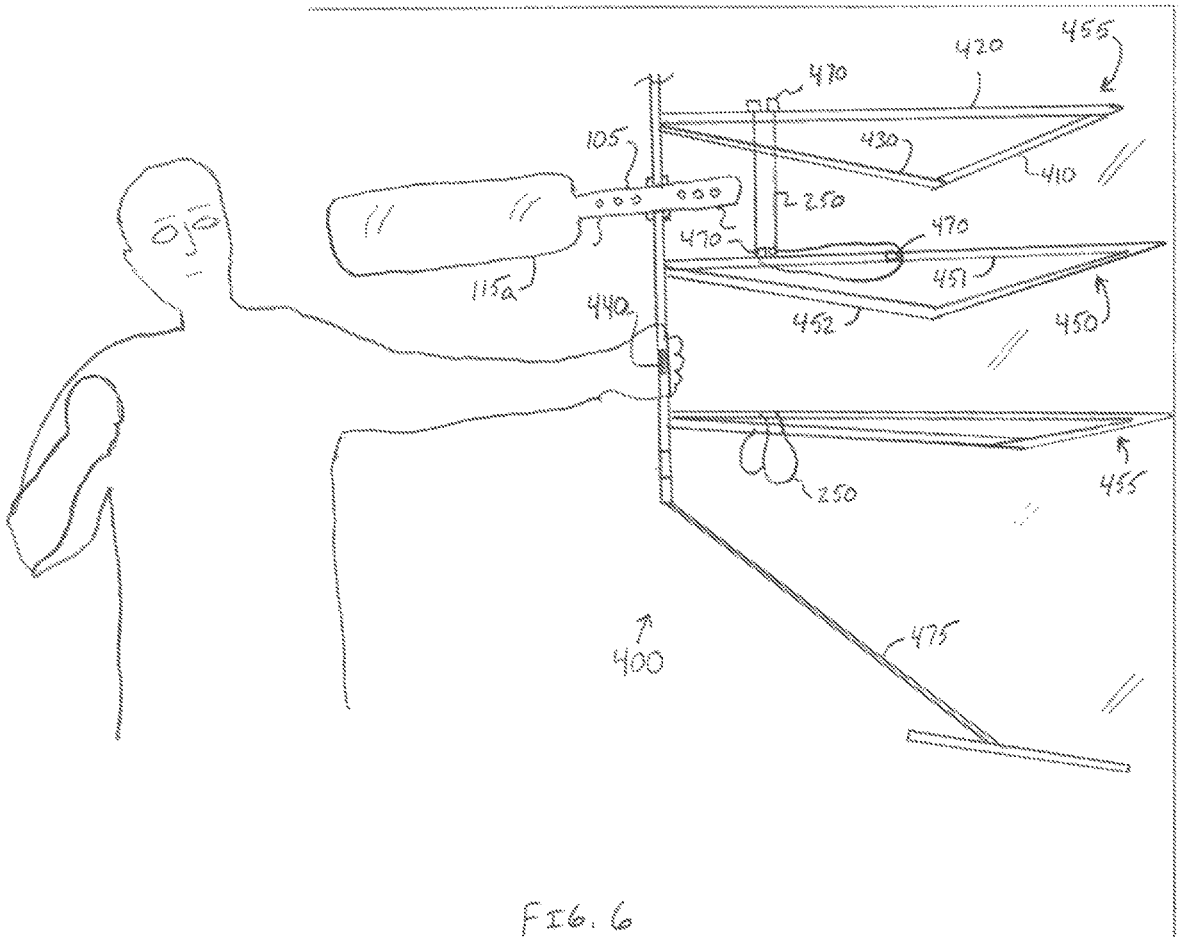
FIG. 6 shows a practitioner practicing with the framework assembly of FIG. 5.

Referring now to FIG. 6, assembly 400 is shown in an operational configuration according to one embodiment. In this and other embodiments, bands 250 can be disposed upon and coupled to the framework 400 to provide return of pads 115*a*, 115*b* (if attached) once struck. In the example of FIG. 6, a band 250 spans the top A-frame assembly 455 and the middle framework 450. When the practitioner strikes the pad 115*a* as shown, the striking arm 100 rotates away from the practitioner, but is returned back at him by virtue of contacting the band 250. In this configuration, the practitioner can practice, e.g., repeated hook punches from either side of the assembly 400. Furthermore, the speed with which the practitioner can practice his punches can depend on where the pad is struck—i.e., the closer the pad is to the band when struck, the faster it will return.

In this embodiment, the assembly 400 includes a bottom brace member 475 that is configured to assist in supporting the various A-frame members 455. In this and other embodiments, any number of A-frame members can be added to the assembly 400, each of which can support a striking arm 100. Thus, an assembly can include, e.g., 1, 2, 3, 4 or more horizontally-rotatable, striking arms 100, wherein each striking arm is coaxially aligned in the vertical direction.

In this and other embodiments, bands 250 can be attached to striking arm 100, e.g., as shown in FIG. 6 or, alternatively, bands 250 can be attached to either or both end portions 135*a*, 135*b* to provide different types of striking arm 100 rotation behavior. It should be understood that the number and ways in which bands 250 can be used to control rotation of striking arm 100 are practically limitless and can be selected as desired by the practitioner.

Figure 7:
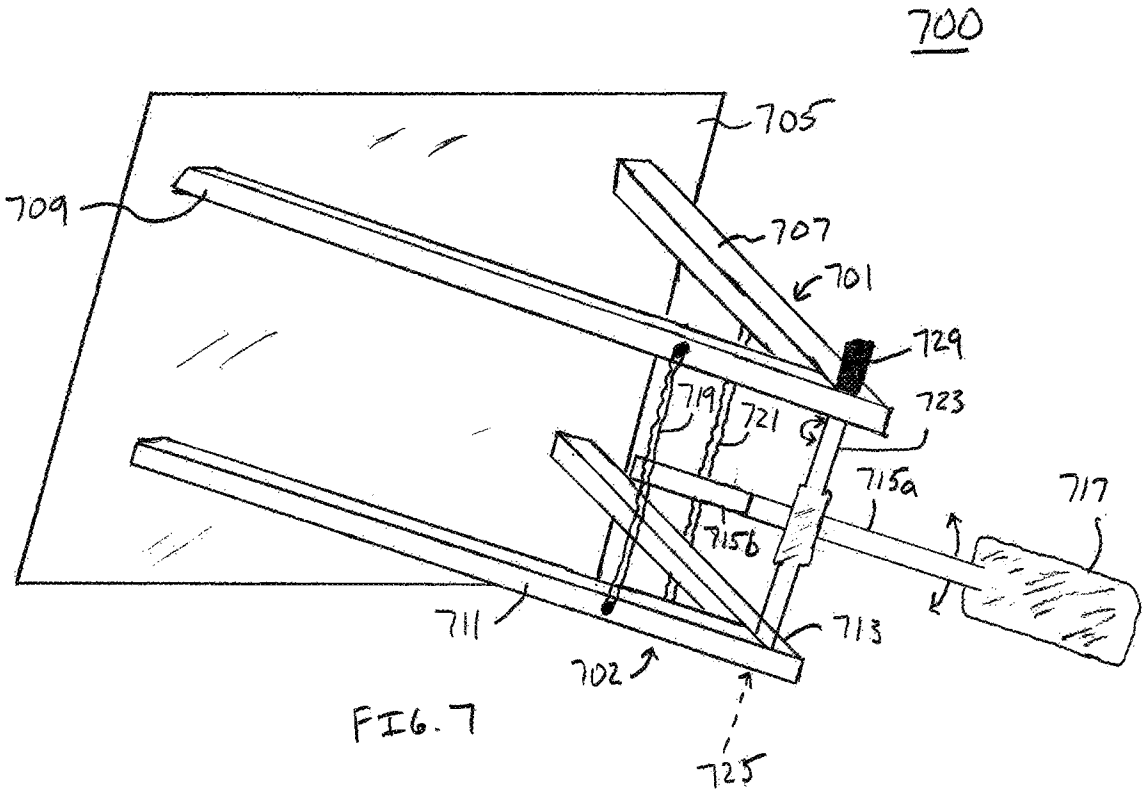
FIG. 7 illustrates a strike-practice assembly according to one embodiment.

Referring now to FIG. 7, a striking assembly 700 is illustrated according to one alternative embodiment. In this embodiment, the striking assembly 700 is configured to be mounted to a vertical surface, such as a wall via base plate 705. First and second V-shaped frame members, 701, 702, each including frame members 707, 709 and 711, 713 respectively, are coupled to the base plate 705 as illustrated. Shaft 723 spans the apexes of the first and second v-shaped frame members 701, 702 as shown. Rod 715*a* is coupled to, and extends through shaft 723; a striking surface 717 is coupled to rod 715*a* at one end as shown. Striking surface 717 can be, e.g., a striking pad. In this and other embodiments, shaft 723 can itself be rotatable, e.g., by coupling each opposite end to V-shaped frame members 701, 702 via a bearing assembly; or, e.g., a rotatable bearing assembly can be integral to shaft 723, e.g., at the midsection and configured to allow rod 715*a* to be coupled thereto.

Shaft 723 is configured to rotate about its long axis to allow rod 715*a* to rotate in a plane that is substantially parallel with the first and second V-shaped frame members 701, 702. The configuration of striking assembly 700 allows for multiple different modes of rotation of rod 715*a* and striking surface 717. In this example, first and second elastic bands 719, 721, respectively, can be stretched between the first and second V-shaped frame members 701, 702 as shown. Additionally, rod 715*a* is extendable by inserting an extension member 715*b* onto the end opposite where striking surface 717 is coupled. In such a configuration, when the striking surface 717 is struck, extension member 715*b* contacts one of the elastic bands 719, 721 (depending on which direction the striking surface was struck from) and thereby restricts rotational movement of rod 715*a*. The elasticity of the elastic bands 719, 721 reverses the direction of rod 715*a*, so that, in practice a practitioner can instigate a pendulum-like motion as the striking surface moves back and forth.

In this embodiment, a second practice mode can be achieved by removing one of the elastic bands 719, 721, resulting in striking surface 717 traveling a greater distance along an arc defined in part by the length of rod 715*a*. For example, if elastic band 719 were removed and striking surface 717 were struck from the left as viewed in FIG. 7, rod 715*a* would contact elastic band 721 and be reversed. The second practice mode can achieve an arc of travel of approximately 180 degrees; however, the position of the elastic bands 719, 721 and the respective lengths of extension member 715*b*, rod 715*a* and striking surface 717 can be configured as desired to achieve any travel arc distance. In a third practice mode, both of the elastic bands 719, 721 can be removed to allow rod 715 to spin freely.

In this embodiment, striking assembly 700 provides modularity to allow multiple striking surfaces to be stacked. For example, in this embodiment, the second V-shaped frame member 702 includes a recess 725 (not visible in FIG.

7) that is configured to receive a post member 729 of a second striking assembly 700. To assemble multiple striking assemblies, post 729 of a first striking assembly 700 is fit into recess 725 of a second striking assembly 700, and the base member 705 of the second striking assembly is coupled to a vertical surface, such as a wall, above the first striking assembly.

A number of illustrative embodiments have been described. Nevertheless, it will be understood that various modifications may be made without departing from the spirit and scope of the various embodiments presented herein. Accordingly, other embodiments are within the scope of the following claims.

What is claimed is:

1. A strike practice assembly, comprising:

a wall-mounted frame assembly supporting a rotatably-mounted arm having a striking pad mounted thereupon at a first end portion, said rotatably-mounted arm being coupled to a vertical support member such that said rotatably-mounted arm rotates in a horizontal plane; and at least one band-attachment member disposed on said rotatably-mounted arm for receiving a first portion of at least one elastic band;

wherein said at least one band-attachment member and said elastic band are configured to provide adjustable rebound of said rotatably-mounted arm when said striking pad is struck;

wherein the length of said rotatably-mounted arm is adjustable;

wherein said frame assembly comprises at least one A-frame assemblies comprising first and second beam members, each having a proximal and distal end portion; and wherein said proximal end portions of said first and said second beam members converge and at least partially support said vertical support member; and wherein said distal end portions of said first and said second beam members is configured to be attached, directly or indirectly, to a vertical wall surface.

2. The strike practice assembly of claim 1, wherein a second, different portion of said elastic band is coupled to said frame assembly.

3. The strike practice assembly of claim 1, comprising between two and four band-attachment members.

4. The strike practice assembly of claim 3, comprising a plurality of band-attachment members disposed along a long axis of said rotatably-mounted arm.

5. The strike practice assembly of claim 1, wherein said frame assembly comprises a rotatably-mounted shaft spanning first and second V-shaped frame members, wherein each of said first and second V-shaped members are coupled to a base.

6. The strike practice assembly of claim 5, wherein said rotatably-mounted shaft is coupled to the apex of each of said first and second V-shaped frame members.

7. The strike practice assembly of claim 5, further comprising:

a post member disposed proximal to the apex of said first V-shaped frame member; and a recess having a complimentary size and shape to receive said post member, disposed proximal to the apex of said second V-shaped frame member.

8. The strike practice assembly of claim 7, wherein said strike assembly is modularly configured to couple to a second one of said strike practice assemblies.

9. The strike practice assembly of claim 1, wherein said frame assembly comprises at least two beam members configured such that a first end portion of each of said beam members converge to form an apex.

10. The strike practice assembly of claim 1, wherein said at least one band-attachment member and said at least one elastic band are configured to provide adjustable rotational travel of said rotatably-mounted arm.

11. The strike practice assembly of claim 1, wherein said rotatably-mounted arm is configured to receive a reversibly-insertable extension member on an end portion opposite said striking pad.

12. The strike practice assembly of claim 10, wherein said adjustable rotational travel of said rotatably-mounted arm is one of:

approximately thirty (30), sixty (60), ninety (90), one-hundred eighty (180), two-hundred seventy (270) or three-hundred sixty (360) degrees.

13. A strike practice assembly, comprising:

a wall-mounted frame assembly comprising at least three beam members configured such that a first end portion of each of said beam members converge to form an apex;

a rotatable arm, comprising:

a striking pad coupled to a first end portion; and a stop member extending substantially perpendicularly therefrom;

wherein said rotatable arm is coupled to said apex and configured to rotate in a horizontal plane;

an elastic band coupled proximal to said apex; and a band-attachment member coupled proximal to said apex that is configured to allow said elastic band to be extended such that contact is made between said elastic band and said stop member when said rotatable arm rotates;

wherein the length of said rotatable arm is adjustable;

wherein said A-frame assembly comprises first and second beam members, each having a proximal and distal end portion; and wherein said proximal end portions of said first and said second beam members converge and at least partially support said vertical support member; and wherein said distal end portions of said first and said second beam members is configured to be attached, directly or indirectly, to a vertical wall surface.

14. The strike practice assembly of claim 13, wherein said band-attachment member is substantially U-shaped.

15. The strike practice assembly of claim 13, further comprising a base member configured to mount said strike practice assembly to a surface.

16. The strike practice assembly of claim 13, wherein the length of said adjustable arm is adjustable.

17. A strike practice assembly, comprising:

a rotatable arm member coupled to a vertical support member of a frame assembly;

wherein said frame assembly is configured to be mounted on a wall surface, and wherein said rotatable arm member is configured to rotate in a horizontal plane and comprises a padded striking surface disposed on one end thereof; and at least one combination of an elastic band and an elastic band catch, wherein said elastic band catch is disposed on said rotatable arm member;

wherein said at least one combination of an elastic band and an elastic band catch provide the capability of rebounding said rotatable arm after said striking surface has been struck;

wherein the length of said extendable arm is adjustable;

wherein said frame assembly comprises at least one A-frame assemblies comprising first and second beam members, each having a proximal and distal end portion; and wherein said proximal end portions of said first and said second beam members converge and at least partially support said vertical support member; and wherein said distal end portions of said first and said second beam members is configured to be attached, directly or indirectly, to said wall surface.

18. The strike pad assembly of claim 17, wherein one portion of said elastic band is coupled to said frame assembly.

19. The strike pad assembly of claim 17, wherein when said at least one combination of an elastic band and an elastic band catch is configured such that two of said elastic bands can be engaged to said rotatable arm.

* * * * *